US009267248B2

(12) United States Patent
Christ et al.

(10) Patent No.: US 9,267,248 B2
(45) Date of Patent: Feb. 23, 2016

(54) HYDRAULIC CONTROL ARRANGEMENT FOR THE SCREED OF A ROAD FINISHER

(75) Inventors: Hermann Christ, Bubach (DE); Irina Hagen, Halsenbach (DE)

(73) Assignee: BOMAG GMBH, Boppard (DE)

( * ) Notice: Subject to any disclaimer, the term of this patent is extended or adjusted under 35 U.S.C. 154(b) by 536 days.

(21) Appl. No.: 12/720,580

(22) Filed: Mar. 9, 2010

(65) Prior Publication Data

US 2010/0284742 A1 Nov. 11, 2010

(30) Foreign Application Priority Data

Mar. 9, 2009 (DE) ..... 10 2009 012 384
May 4, 2009 (DE) ..... 10 2009 019 839

(51) Int. Cl.
*E01C 19/48* (2006.01)

(52) U.S. Cl.
CPC ..... *E01C 19/48* (2013.01); *E01C 2301/14* (2013.01)

(58) Field of Classification Search
CPC ..... E01C 19/00; E01C 19/002; E01C 19/185; E01C 19/22; E01C 19/48; E01C 19/405
USPC ..... 404/83, 84.05, 84.1, 118
See application file for complete search history.

(56) References Cited

U.S. PATENT DOCUMENTS 2,295,519 A * 9/1942 Millikin et al. ..... 404/84.1
2,775,925 A * 1/1957 Greiner ..... 404/123
3,396,642 A * 8/1968 Martinson ..... 404/114
3,606,827 A 9/1971 Miller et al.
3,776,326 A 12/1973 Davin et al.
3,936,211 A * 2/1976 Miller et al. ..... 404/104
3,992,124 A * 11/1976 Schrader ..... 404/118
4,026,658 A * 5/1977 Neuendorf et al. ..... 404/84.05
4,590,919 A 5/1986 Spani et al.
4,655,633 A * 4/1987 Somero et al. ..... 404/75
4,682,908 A * 7/1987 Domenighetti ..... 404/84.1
4,759,657 A * 7/1988 Dorr et al. ..... 404/72
4,811,607 A * 3/1989 Walters et al. ..... 73/861.53
4,930,935 A * 6/1990 Quenzi et al. ..... 404/75
5,393,167 A * 2/1995 Fujita et al. ..... 404/84.1

(Continued)

FOREIGN PATENT DOCUMENTS

BE 591275 9/1960
DE 31 24 363 A1 12/1982

(Continued)

OTHER PUBLICATIONS

International Standard (ISO 2006), Second Edition Oct. 15, 2006, Corrected Version Mar. 15, 2007, S. ii-iv, S. 25-27.

*Primary Examiner* — Matthew D Troutman
(74) *Attorney, Agent, or Firm* — Baker & Hostetler LLP

(57) ABSTRACT

A hydraulic control arrangement for activating a double-acting actuating cylinder, which is connected on the piston side to a road finisher and on the piston-rod side to a screed of the road finisher, is provided. The hydraulic control arrangement includes a supply connection, a tank connection and two consumer connections, in which a loading pressure or a relief pressure is applied to the piston of the actuating cylinder via the consumer connections. The loading pressure or relief pressure is controlled as a function of a defined operating state, and, in a controlling-the-screed-load operating state, the relief pressure supplied to the actuating cylinder on the piston-rod side is controlled via a proportional pressure control valve.

8 Claims, 13 Drawing Sheets

(56) References Cited

U.S. PATENT DOCUMENTS

| | | | | |
|---|---|---|---|---|
| 5,556,227 | A * | 9/1996 | Ulrich | 404/101 |
| 6,152,647 | A * | 11/2000 | Tapio et al. | 404/75 |
| 6,183,160 | B1 * | 2/2001 | Tapio et al. | 404/84.1 |
| 6,749,364 | B1 * | 6/2004 | Baker et al. | 404/84.5 |
| 7,195,423 | B2 * | 3/2007 | Halonen et al. | 404/84.5 |
| 7,204,185 | B2 * | 4/2007 | Ma et al. | 91/446 |

FOREIGN PATENT DOCUMENTS

| | | | |
|---|---|---|---|
| DE | 35 35 362 | C1 | 3/1987 |
| DE | 3825129 | | 1/1990 |
| DE | 4211286 | | 10/1993 |
| DE | 19982943 | | 8/2001 |
| DE | 10155507 | | 5/2003 |
| DE | 10311156 | | 12/2004 |
| DE | 102005022266 | | 11/2006 |
| EP | 0 115 567 | | 8/1985 |
| EP | 1079116 | | 2/2001 |
| FR | 26 66 104 | A1 | 2/1992 |
| FR | 2666104 | A1 | 2/1992 |
| JP | H07-68684 | | 7/1995 |
| JP | H10266274 | | 10/1998 |
| JP | 2002227233 | | 8/2002 |
| JP | 2002285513 | A | 10/2002 |
| JP | 2006161290 | A | 6/2006 |
| JP | 2006161421 | A | 6/2006 |
| JP | H0712403 | | 3/2007 |
| WO | WO0206679 | | 1/2002 |

* cited by examiner

HYDRAULIC CONTROL ARRANGEMENT FOR THE SCREED OF A ROAD FINISHER

CROSS-REFERENCE TO RELATED APPLICATIONS

This application claims priority from foreign Patent Application Nos. DE 10 2009 012 384.9, filed on Mar. 9, 2009, and DE 10 2009 019 839.3, filed on May 4, 2009, the disclosures of which are incorporated herein by reference in their entirety.

FIELD OF THE INVENTION

The present invention relates to a hydraulic control arrangement and a control system for a screed of a road finisher. The invention further relates to a road finisher equipped with a hydraulic control arrangement or a control system.

BACKGROUND OF THE INVENTION

In conventional road finishers with floating screeds, the screed, which is articulated to the chassis of the road carrier and is drawn thereby, is held in a desired position or moved, so that defined laying conditions are met, by means of hydraulic actuating cylinders which are connected on the piston side or housing side to the chassis of the road finisher and on the piston-rod side to the screed.

In the laying of mixed material, allowance must be made for various factors which decisively influence the laying quality. For example, the temperature of the mixed material to be laid has an important role. It is also important to adhere to a constant laying speed. External disturbances may mean that the position of the screed has to be rapidly altered in relation to the substrate. During stopping or starting of the road finisher, particular skill is required in order to properly carry out the construction work and thus to avoid expensive reworking

SUMMARY OF THE INVENTION

Embodiments of the present invention advantageously avoid the drawbacks of conventional control or regulation of hydraulic actuating cylinders for screeds and of improving the laying quality. Furthermore, the activation should be efficient and involve as little loss as possible.

The inventive control arrangement is embodied in such a way that the loading pressure or relief pressure can be controlled as a function of a defined operating state, the relief pressure supplied on the piston-rod side to the actuating cylinder being controlled via a proportional pressure control valve in a "controlling the screed load" operating state.

The term "loading pressure" refers in this case to that pressure which leads to lowering of the screed. Accordingly, the term "relief pressure" refers to that pressure which leads to raising of the screed. "Defined operating states" may differ as a function of the laying speed or speed of travel of the road finisher. The term "defined operating states" also includes starting or stopping processes. As stated at the outset, unexpected disturbances, for example ground unevenness, changes in temperature, etc. can occur on a construction site, thus impeding uniform laying of road topping. According to embodiments of the present invention, the work of the operator of the road finisher is facilitated in so far as he can define operating states or modes of operation so that the laying quality is kept constant despite external influences.

Preferably, the loading pressure or relief pressure is controlled as a function of the speed of travel of the road finisher.

The screed "floats" during use on the mixed material and experiences as a function of the laying speed different forces acting on it. It is therefore preferable to use the speed of travel of the road finisher as a parameter for controlling the loading or relief pressure.

Preferably, the hydraulic control arrangement is furthermore arranged in such a way that, in a "lowering the screed" operating state, the hydraulic oil issuing on the piston-rod side and entering the hydraulic control arrangement via a second consumer connection is returned to the piston side of the hydraulic cylinder via a first consumer connection.

Furthermore, it is preferable for the hydraulic control arrangement to be embodied in such a way that, in the "lowering the screed" operating state, the hydraulic oil is supplied from a tank to the piston side of the hydraulic cylinder via a further—external or internal—tank connection.

In an advantageous embodiment of the present invention, the hydraulic control arrangement has a double flow controller. A "double flow controller" comprises two flow controllers which are connected in parallel and are each provided, on account of check valves, only for one direction of flow. This double flow controller is preferably arranged in that line portion which is connected to the piston side of the hydraulic cylinder. The provision of the double flow controller allows uniform raising and lowering of the screed.

In a further preferred embodiment, the hydraulic control arrangement comprises a pressure sensor which is embodied to detect the piston-rod or piston side pressure, the loading pressure or relief pressure being controlled as a function of the detected piston-rod and/or piston side pressure. Two further parameters, namely the pressure on the housing or piston side and the pressure on the piston-rod side of the hydraulic cylinder, are thus available for controlling the loading or relief pressure of the screed. As the pressure sensors are arranged in direct proximity to the cylinder, it is possible to react rapidly and to set the desired values when required.

Preferably, the volumetric flow of hydraulic oil which is conducted to the hydraulic control arrangement via supply connection or the supply pressure being present at the supply connection is controllable in a low-loss way by a control pump. Thereby, it is possible to adjust a desired value of volumetric flow or pressure as needed instead of applying a constant volumetric flow or a constant pressure. For example, the pressure can exhibit a higher value when starting or stopping the road finisher than in the normal operation. Pre- and after-running control is possible.

Embodiments of the present invention further relate to a control system with two of the described hydraulic control arrangements. In this case, the control system comprises two double-acting hydraulic cylinders which on the piston-rod side are connected to the screed so as to oppose one another with respect to a symmetry axis of the screed, wherein they can be controlled independently of one another. In order to increase the working width, the main screeds of road finishers are equipped with extendable or attachable additional screeds. There are laying situations in which these additional screeds cannot be arranged symmetrically with one another. In this case, it is advantageous to separately activate the hydraulic cylinders which are connected to the main screed so as to oppose one another with respect to the symmetry axis of the main screed, so that overall symmetrical loading or relieving of the screed can be achieved despite the asymmetrical distribution of weight. For example, the respective relief pressure in the cylinders is altered proportionally to the non-symmetrical widening of the screed, so that a uniform line loading of the screed is achieved. The two separately controllable hydraulic cylinders are preferably arranged on the left and on the right side of the center of gravity of the main screed, each of the cylinders having the same distance from the center of gravity. If the additional screeds are driven out distance measuring devices which are arranged at the extendable additional screeds directly or in other suitable positions on the road finisher, for example at the extension cylinders, can detect whether and on which side an asymmetrical screed widening is present. Depending on the shift of the center of gravity due to the asymmetrical widening, the left hydraulic cylinder can be charged with a different pressure as the right hydraulic cylinder so that altogether a constant load can be imposed on the asphalt being laid.

Preferably, the volumetric flow of hydraulic oil which is conducted to the hydraulic control system via supply connection or the supply pressure being present at the supply connection is controllable in a low-loss way by a control pump. Thereby, it is possible to adjust a value of volumetric flow or pressure according to the needs instead of applying a constant volumetric flow or a constant pressure.

Preferably, the control system comprises one double flow controller for each hydraulic cylinder.

BRIEF DESCRIPTION OF THE DRAWINGS

The invention will be described hereinafter in greater detail with reference to the figures, in which.

DETAILED DESCRIPTION

Figure 1:
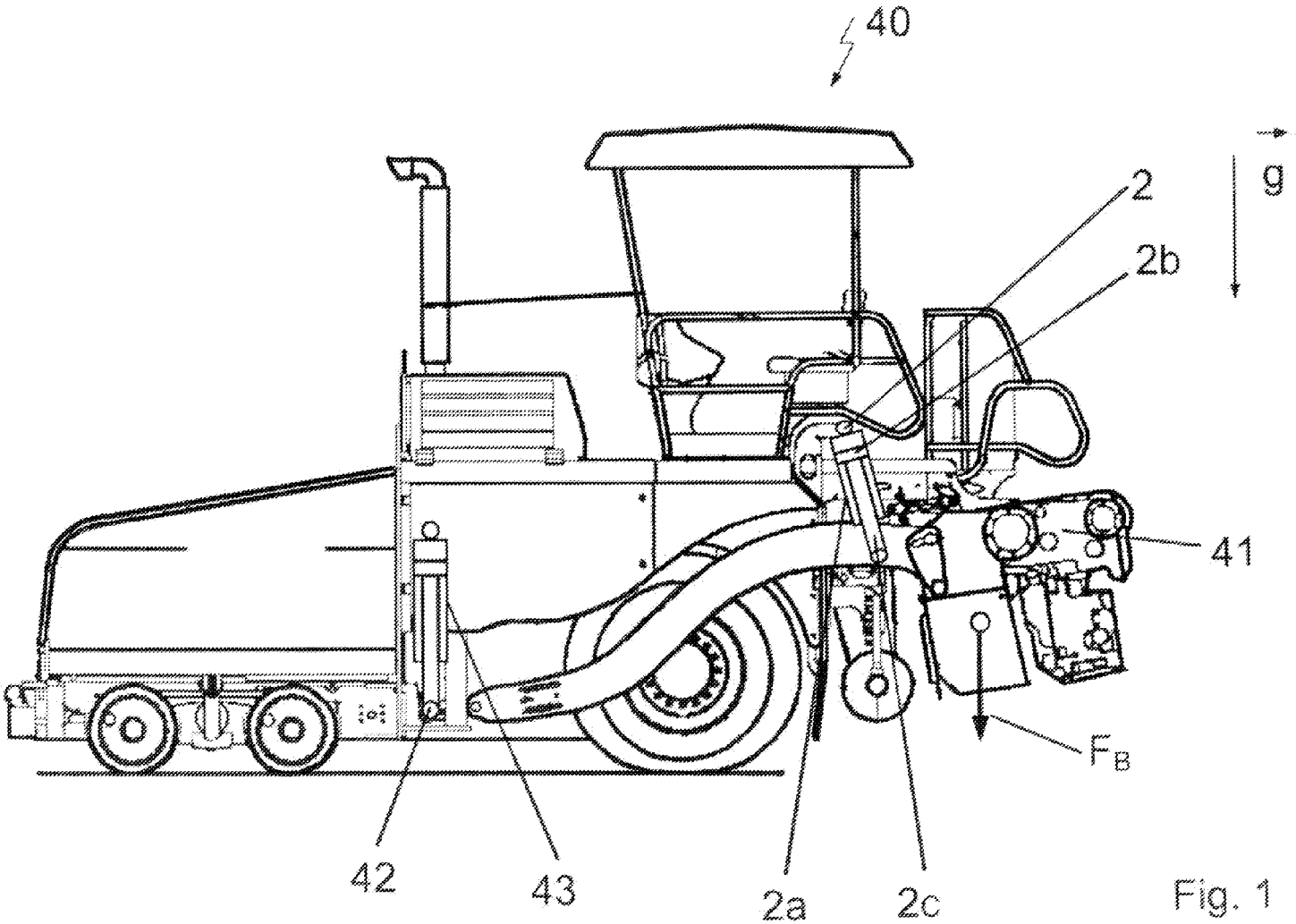
FIG. 1 is a schematic side view of a road finisher with a screed.

FIG. 1 is a side view of a road finisher 40 according to the invention. A screed 41 is articulated to the road finisher 40 at the point 42 and can be raised, lowered and held in any desired position with the aid of a double-acting actuating cylinder 2. The articulation point 42 itself is vertically adjustable via a leveling cylinder 43 in order to define the setting angle of the screed 41. This setting angle determines in combination with the speed of travel primarily the laying thickness. The actuating cylinder 2 is articulated on the piston side, i.e. with the cylinder housing 2*a*, to the chassis of the road finisher 40. On the piston-rod side, the actuating cylinder 2 is articulated to the screed 41. The screed 41 generates, on account of its dead weight, the weight force $F_B$ which is directed perpendicularly downward. In the position shown, the road finisher 40 is en route to the site of use, so that no force is directly exerted by the screed 41 onto the substrate.

Figure 2:
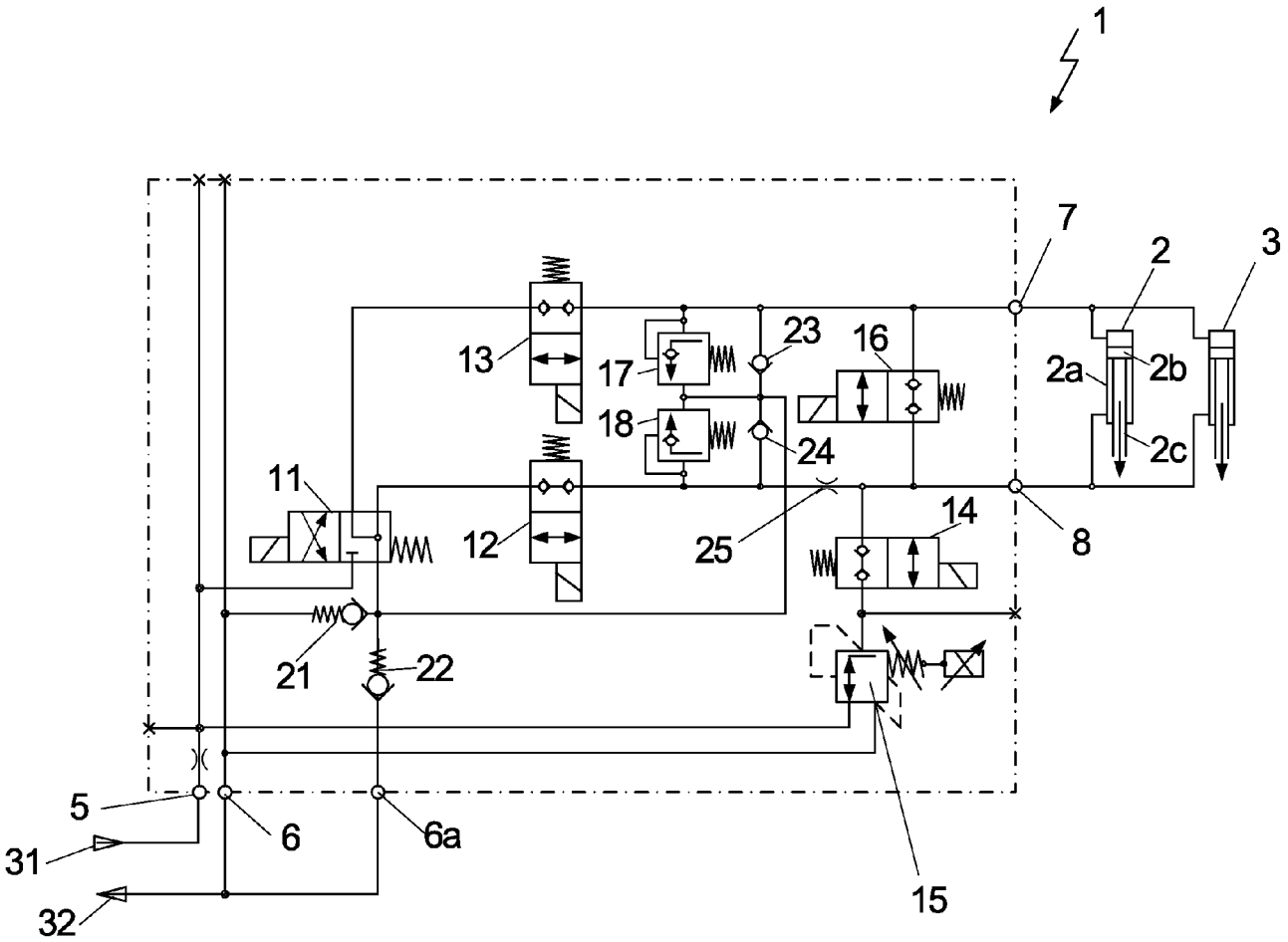
FIG. 2 is a schematic hydraulic diagram of a first exemplary embodiment in the "holding the screed" operating state.

FIG. 2 is a hydraulic diagram of the control arrangement 1 during "holding of the screed." In this mode of operation, the screed 41 is held in the elevated position, for example for a transportation movement. In this case, none of the directional valves 11 to 16 is switched, so that they are not energized. Spring-tensioned check valves 21 to 24 prevent a connection in the mode shown. Preferably, all the valves are designed as seat valves, so that no leakage can occur. The pressures applied on the piston side and on the piston-rod side are maintained, so that the screed 41 cannot be lowered. A further actuating cylinder 3 can preferably be connected in parallel for the purpose of symmetry.

Figure 3:
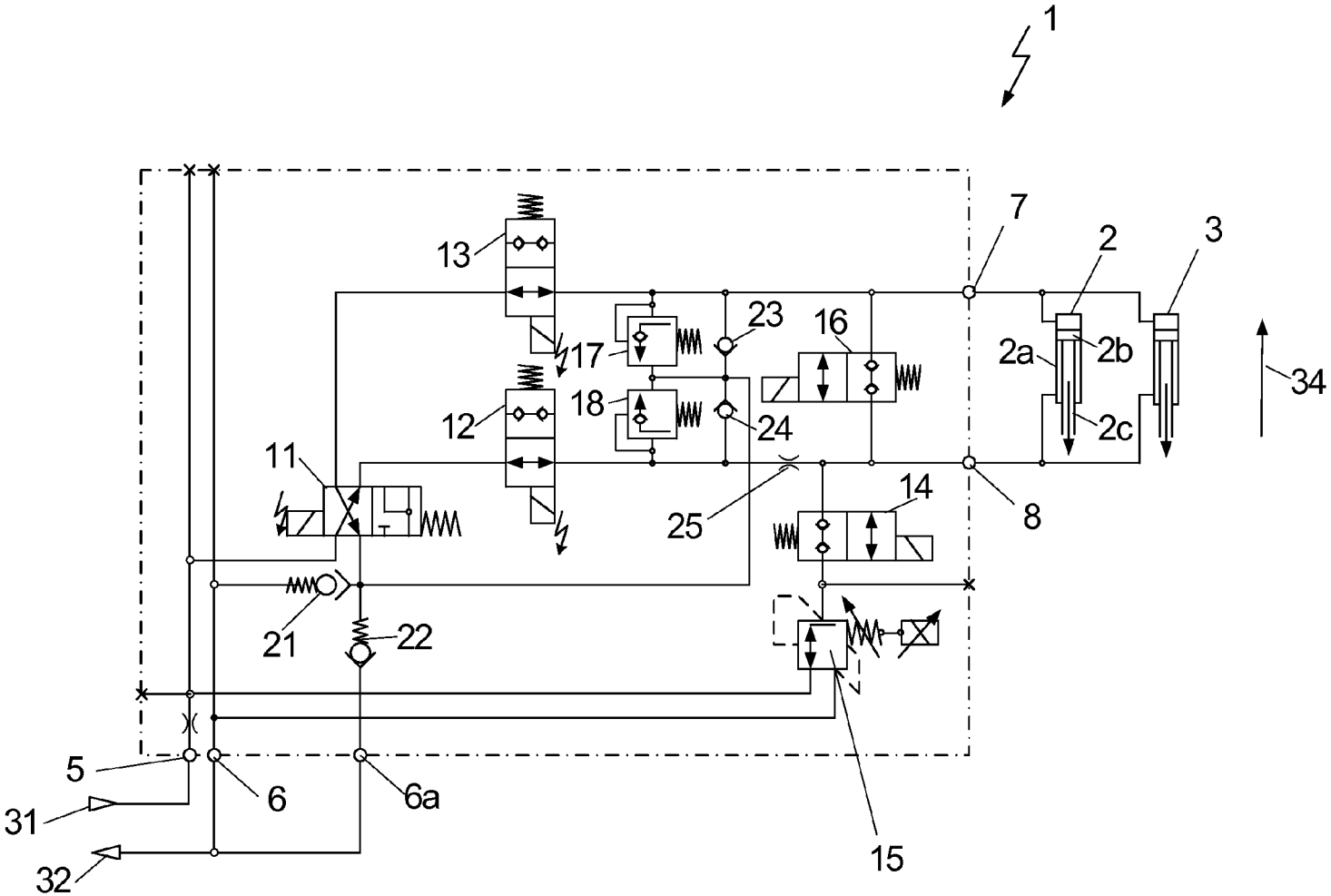
FIG. 3 is a schematic hydraulic diagram of a first exemplary embodiment in the "raising the screed" operating state.

FIG. 3 is a hydraulic diagram of the control arrangement 1 during "raising of the screed." In this case, the directional valves 11, 12, 13 are switched, as may also be seen from the "lightning symbols" next to the valve actuating elements, so that they are energized. The supply pressure, which is preferably constant at 150 bar, other supply pressures also being possible depending on the dimensions of the cylinder and the weight of the screed, is taken for the control arrangement via the supply connection 5. The control arrangement 1 forms one of many units of the road finisher that have various functions. A supply unit (not shown) provides the constant supply pressure, so that a broad range of consumers can be connected thereto in the manner of a "socket." The restricted actuating pressure is applied on the piston-rod side in the actuating cylinder 2 via the valves 11, 12. At the same time, the hydraulic oil is pressed out of the piston side and supplied to the tank connection 6 via the connection 7 and the valves 13, 11, 21. The piston 2*b* is moved upward in the direction of the arrow 34, so that the screed 41 fastened to the piston-rod 2*c* is raised. Preferably, the valve 12 is switched after a delay in order to prevent the screed 41 from sagging slightly at the beginning of the lifting process. Accordingly, the opposite applies during stopping.

Figure 4:
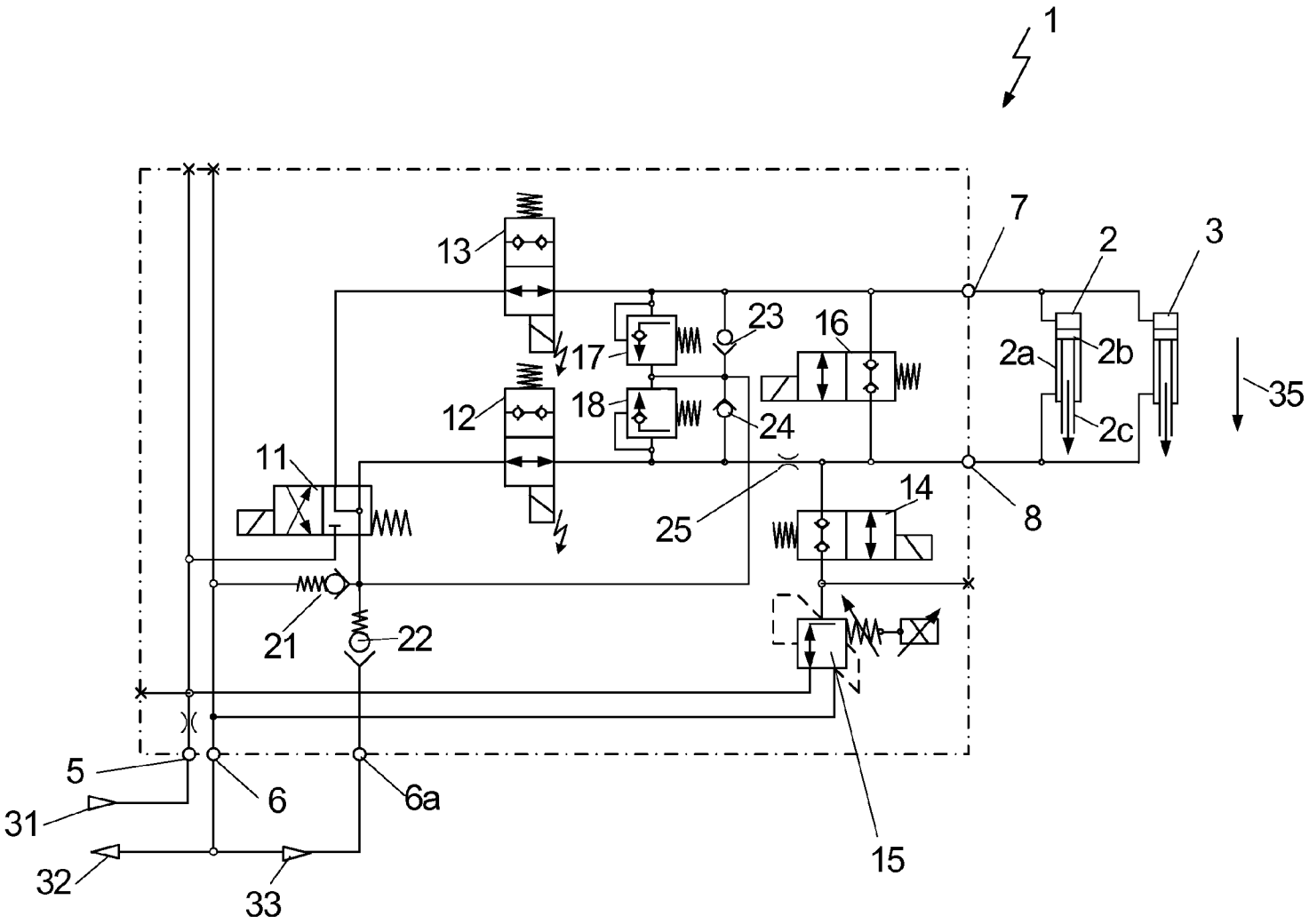
FIG. 4 is a schematic hydraulic diagram of a first exemplary embodiment in the "lowering the screed" operating state.

FIG. 4 is a hydraulic diagram of the control arrangement 1 during "lowering of the screed." Screeds for road finishers can weigh up to several tons. The dead weight of the screed 41 is therefore utilized during the lowering and the valve 11 is brought into the starting position shown. The oil which is displaced on the piston-rod side during the lowering of the screed is restricted via an aperture 25 in order to determine the lowering speed. Valves 12, 13 are energized and the hydraulic oil displaced on the piston-rod side is returned to the piston side of the actuating cylinder 2 via the valve 11. The differential amount that is still missing is topped up from the pretensioned tank connection 6*a* via the check valve 22, so that no cavitation occurs. The piston-rod 2*c* is thus moved along with the screed 41 in the arrow direction 35 shown.

Figure 5:
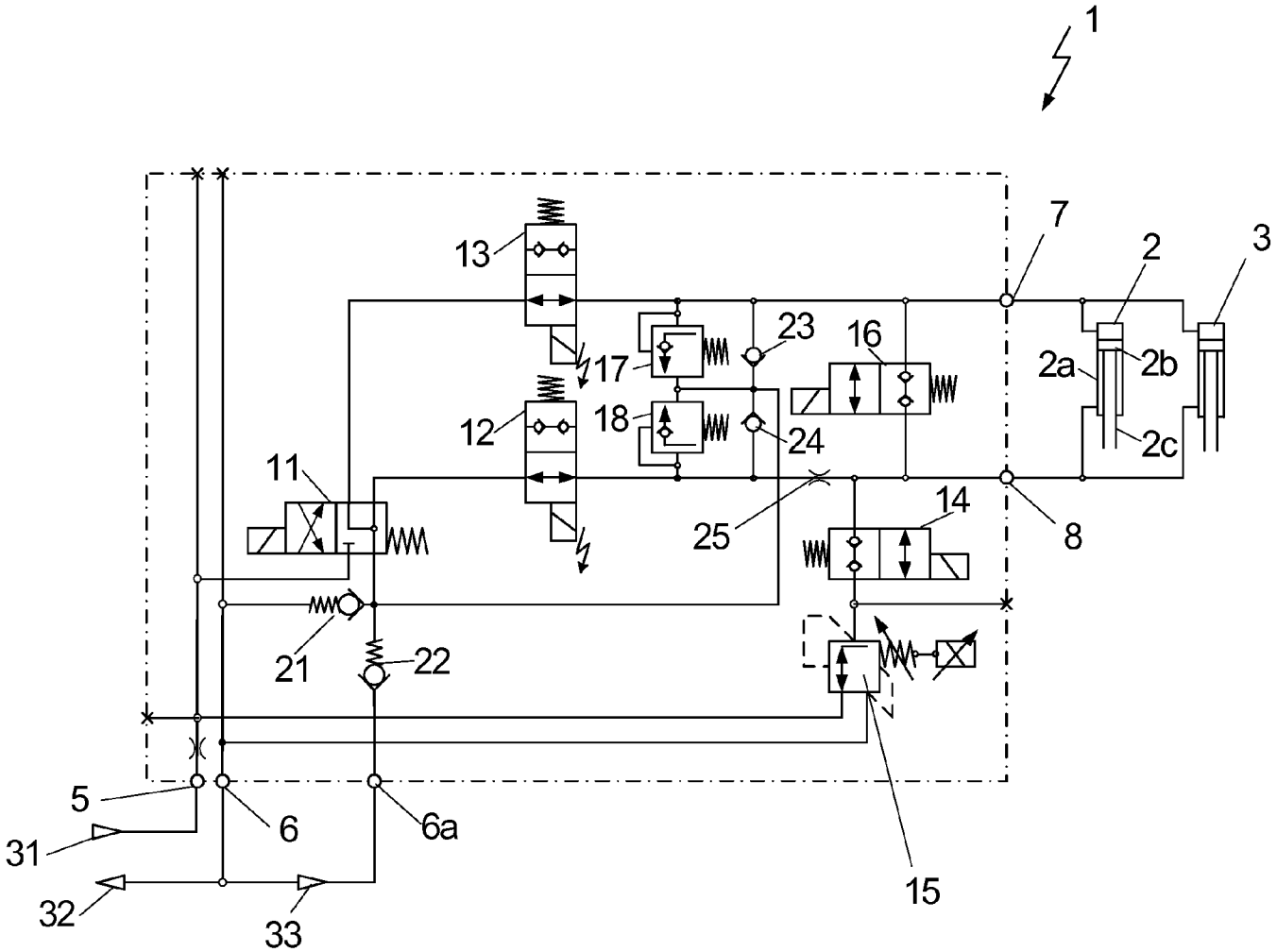
FIG. 5 is a schematic hydraulic diagram of a first exemplary embodiment in the "floating" operating state.

FIG. 5 is a hydraulic diagram of the control arrangement 1 during "floating" of the screed 41. In this case, the screed 41 rests with its full weight on the freshly laid mixed material. Only valves 12, 13 are switched. The piston side and piston-rod side of the actuating cylinders 2, 3 are connected again. The supply connection 5 and tank connection 6 are in this case mainly inoperative. The differential amount is merely compensated for in the event of unevenness, etc. via the check valves 21, 22.

Figure 6:
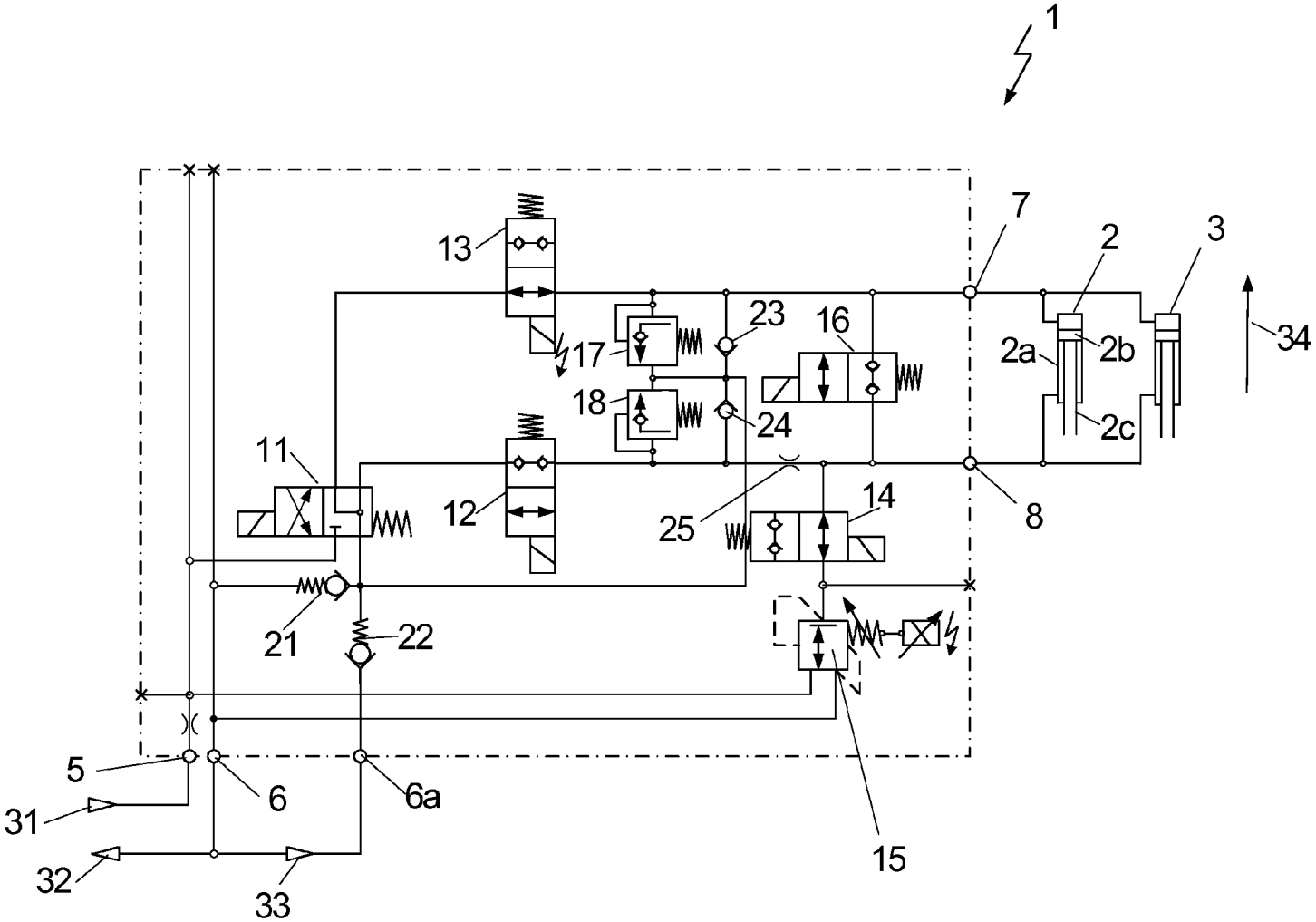
FIG. 6 is a schematic hydraulic diagram of a first exemplary embodiment in the "controlling the screed load" operating state.

FIG. 6 is a hydraulic diagram of the control arrangement 1 during "controlling of the screed load." In order to reduce the screed load depending on the use, a controlled pressure is passed to the piston-rod sides of the actuating cylinders 2, 3 via a pressure control valve 15, for example a proportional valve, which can control the pressure in a wide range of from 7 to 105 bar, for example, and via a valve 14. Preferably, the settable pressure range of the proportional valve 15 begins close to 0. In order to increase the resolution of the pressure controlling range, i.e., to increase the precision of the loading and relief pressure, it is advantageous to optimize the maximum pressure which can be controlled via the proportional valve 15. The relieving of the screed 41 also leads inter alia to an increase of the rear axle load of the road finisher 40, so that better traction is achieved. Secondary pressure limiting valves 17, 18 ensure safety in the case of a system pressure increased by external loading. During stopping, the pressure controlled by the valve 15 is increased in order to compensate for the force generated by the lift during laying so that the screed 41 does not sink in on the hot mixed material. During restarting, the valve 13 is closed for a specific time so as to prevent the screed 41 from swerving upward as a result of its lift on the possibly cooled mixed material. According to one embodiment, the relief pressure can be controlled proportionally to the speed of travel of the road finisher 40.

Figure 7:
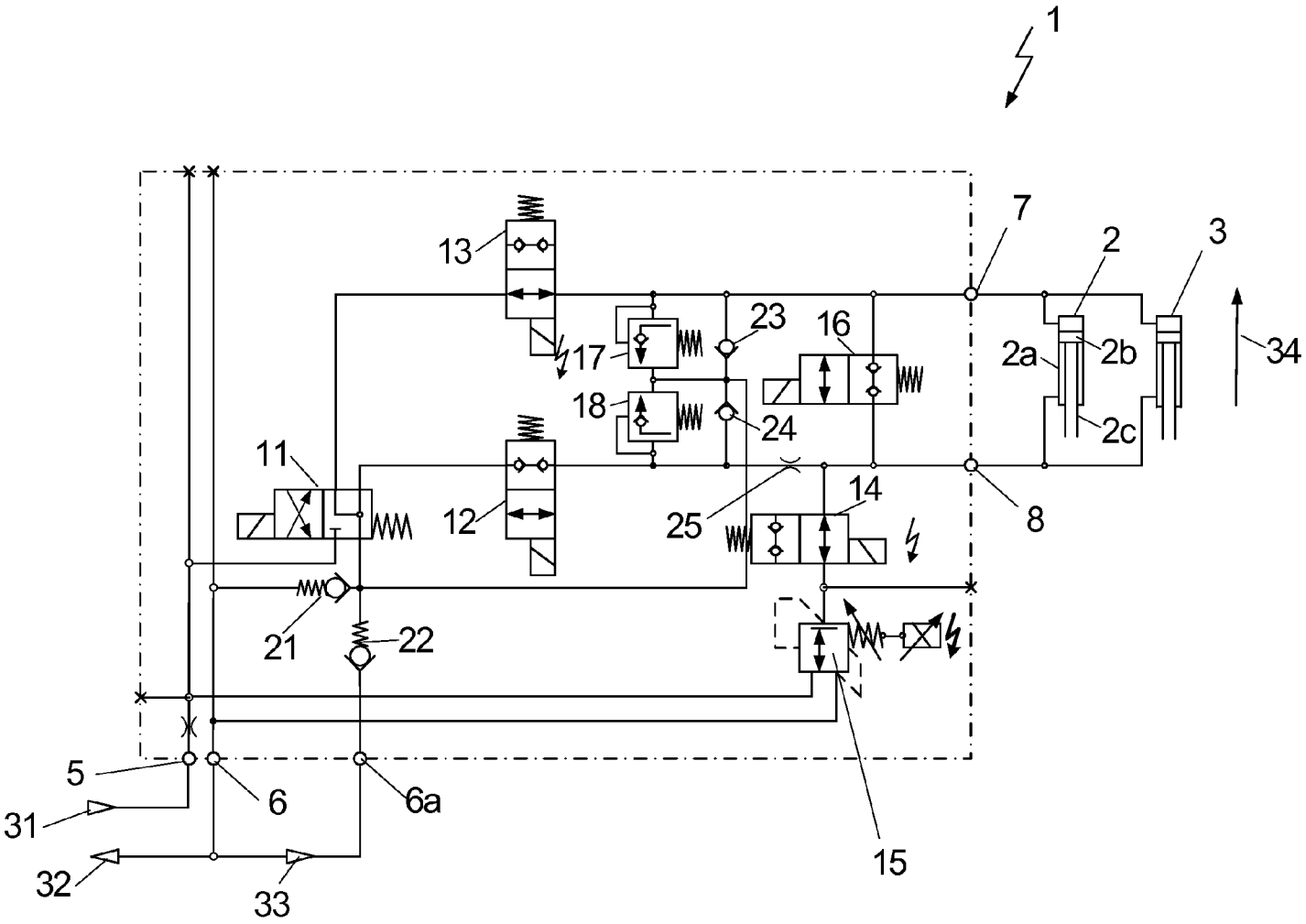
FIG. 7 is a schematic hydraulic diagram of a first exemplary embodiment in the "controlling and relieving" operating state.

FIG. 7 is a hydraulic diagram of the control arrangement 1 during "controlling of the screed load and additional relieving." If, during restarting, cooled mixed material and a requirement for tensile force that is increased as a result cause the wheels to continued to rotate in the wheel-driven road finisher 40, this function can be activated by a spring-loaded pushbutton (not shown). In this case, the screed 41 is relieved, i.e., moved in arrow direction 34, as a result of increased pressure, which can be set at the valve 15, on the piston-rod sides of the actuating cylinders 2, 3, in order in this way to transmit higher tensile forces.

Figure 8:
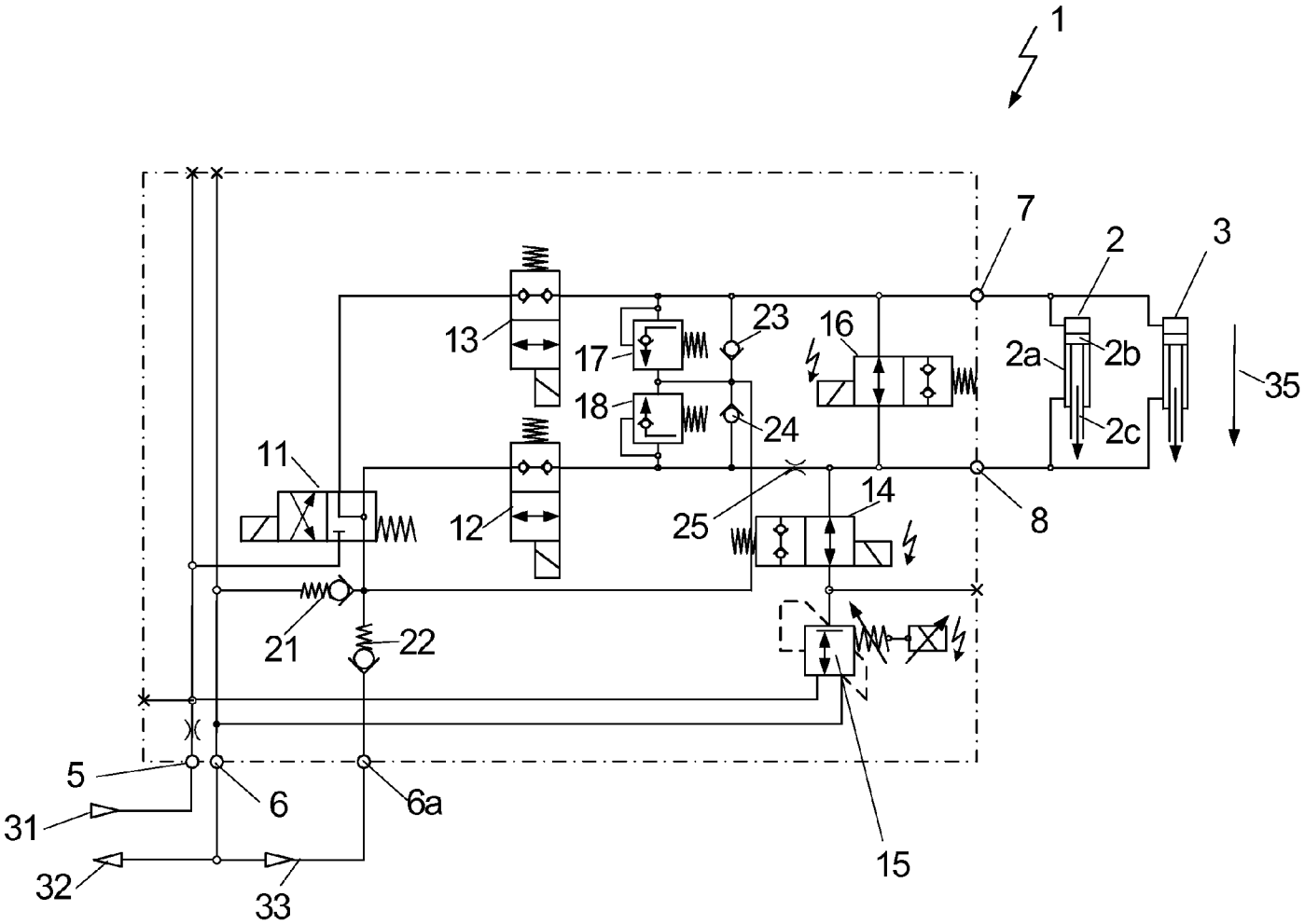
FIG. 8 is a schematic hydraulic diagram of a first exemplary embodiment in the "controlling and pressing-on" operating state.

FIG. 8 is a hydraulic diagram of the control arrangement 1 during "controlling of the screed load and additional pressing-on." The valve 16 may be used, in order to prevent the screed 41 from floating up during restarting, to generate, in addition to the dead weight of the screed, a force which is dependent on the piston/rods ratio and the pressure acting on the screed 41. In this case, the valves 11, 12, 13 are not energized (pretensioned floating position).

The described control arrangement acts in parallel on both hydraulic cylinders 2 and 3. This is sufficient for the majority of applications, in particular in small road finishers. In heavy machines, in particular with widenings of the screed, it may be beneficial to provide the control arrangement separately for each hydraulic cylinder 2, 3, so that each cylinder 2, 3 can be activated separately. Especially when the screed 41 is widened non-symmetrically and the center of gravity of the screed 41 is thus no longer positioned precisely between the two hydraulic cylinders 2, 3, it is advantageous to provide, instead of parallel activation of the cylinders 2, 3 via the control arrangement described above, an independent control arrangement for each cylinder 2, 3. Depending on the position of the center of gravity of the screed 41, it may for example be necessary to relieve one hydraulic cylinder 2 and at the same time to load the other hydraulic cylinder 3.

Figure 9:
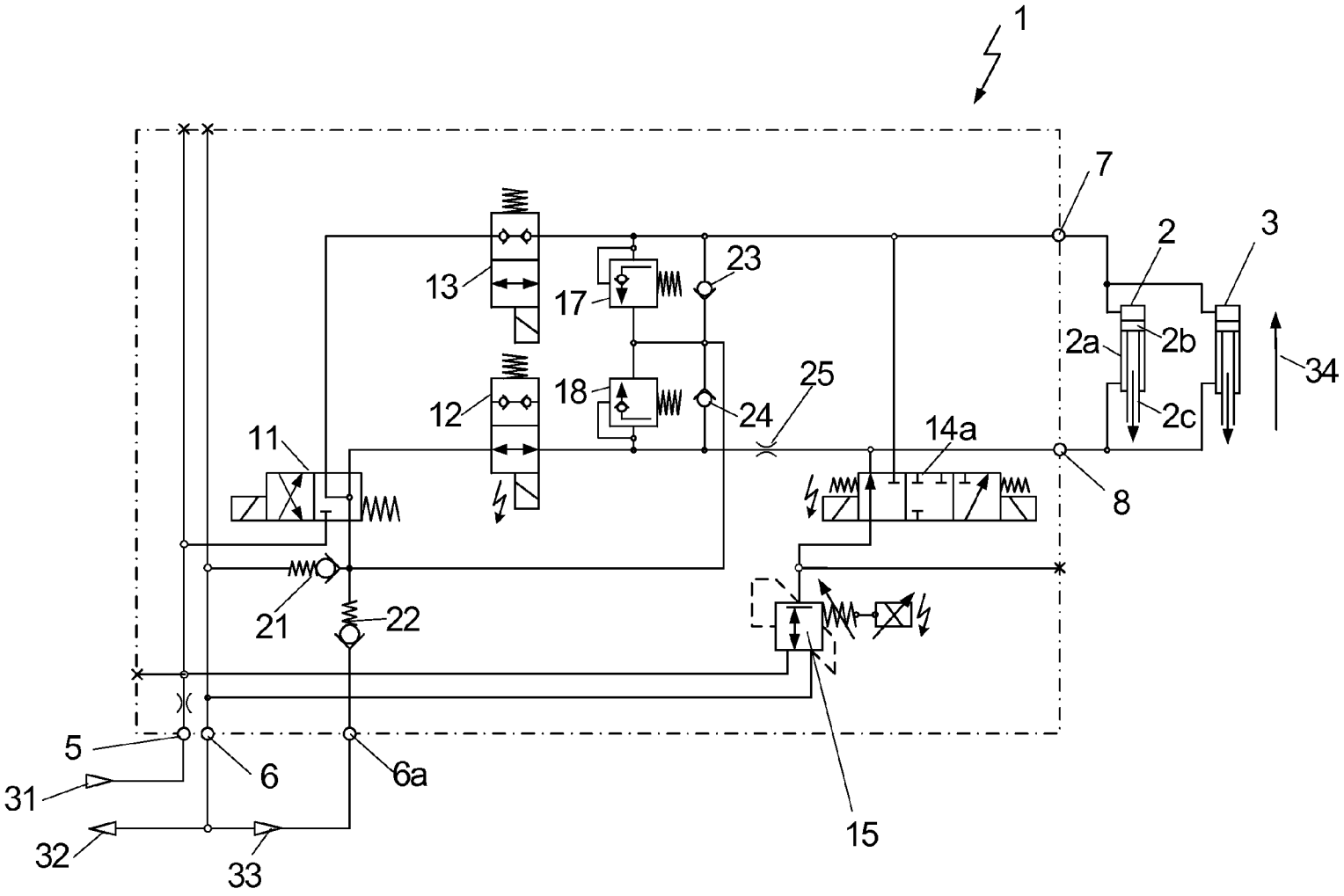
FIG. 9 is a schematic hydraulic diagram of a second exemplary embodiment in the "controlling and relieving" operating state.

FIG. 9 shows an alternative embodiment of the control arrangement. It differs from the first embodiment shown in FIGS. 1 to 8 in that the valves 14 and 16 of the first embodiment have been replaced by a 3/3-way valve 14*a*. In this case too, the screed 41 can be selectively loaded or relieved in accordance with the current state of travel. The advantages over the first embodiment consist, on the one hand, in the reduction of the number of components and, on the other hand, in the simplification of the switching processes, as "pressing-on" the screed 41, i.e., the additional exertion of a defined loading pressure, now requires, instead of two switching processes, namely the switching of valves 14 and 16, just one switching process for the valve 14*a*. In the position shown, the operating mode is the "controlling and relieving" mode. In this case, a controlled relief pressure can be imparted as required to the piston-rod sides of the hydraulic cylinders 2, 3, thus enabling the screed 41 to move in the direction of the arrow 34.

Figure 10:
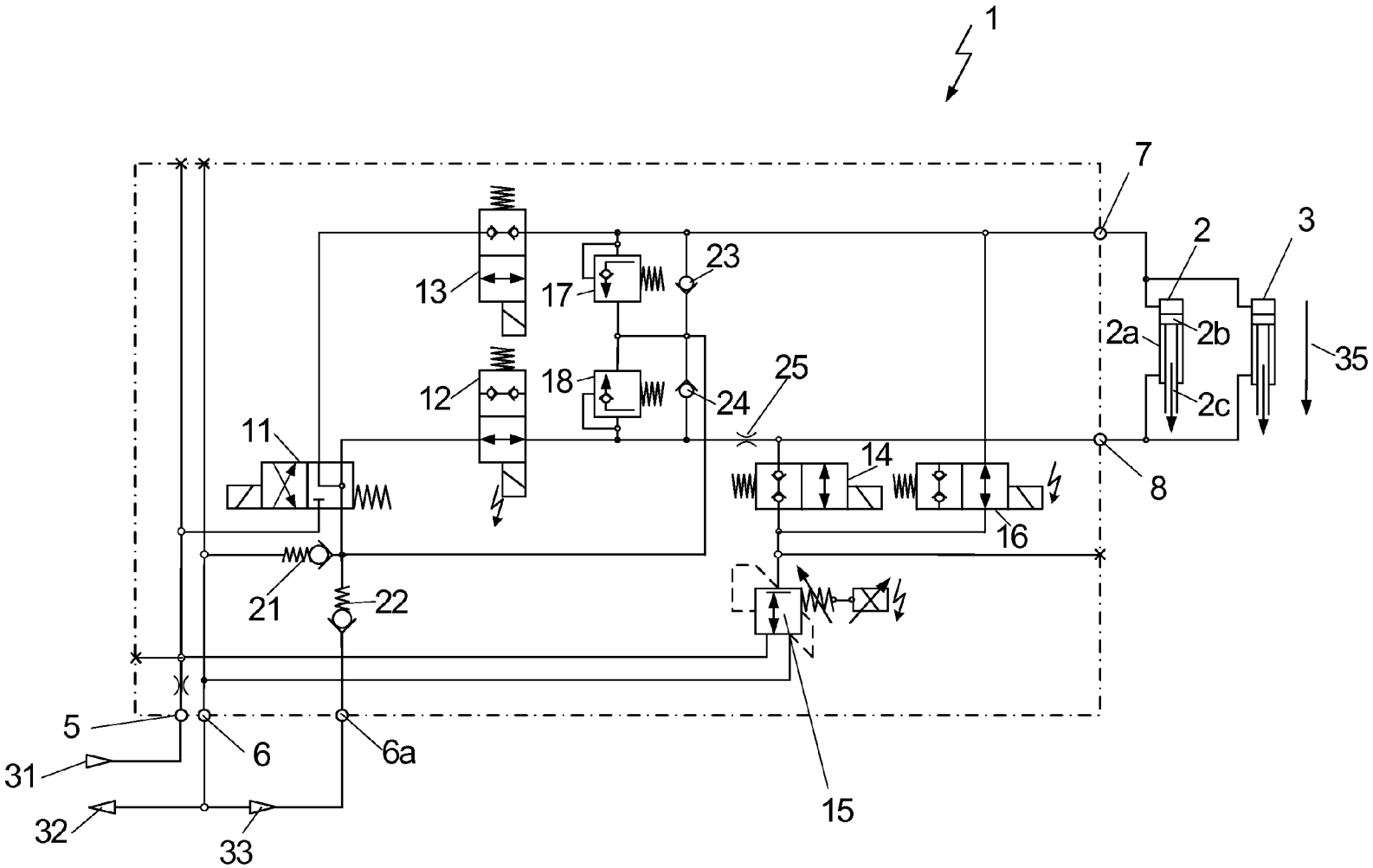
FIG. 10 is a schematic hydraulic diagram of a third exemplary embodiment in the "controlling and pressing-on" operating state.

FIG. 10 shows a further embodiment of the control arrangement. Compared to the exemplary embodiment shown in FIGS. 1 to 8, the 2/2-way valves 14, 16 are arranged no longer at least partially "in series" but in parallel, the outlet of the valve 14 being connected to the piston-rod sides and the outlet of the valve 16 being connected to the piston sides of the hydraulic cylinders 2, 3. With this embodiment too, the screed 41 may be selectively loaded or relieved in accordance with the current state of travel. In the position shown, the pressure controlled via the pressure control valve 15 is applied, by actuating the valve 16, on the piston sides of the hydraulic cylinders 2, 3, so that the screed experiences an additional force in the direction of the arrow 35.

Figure 11:
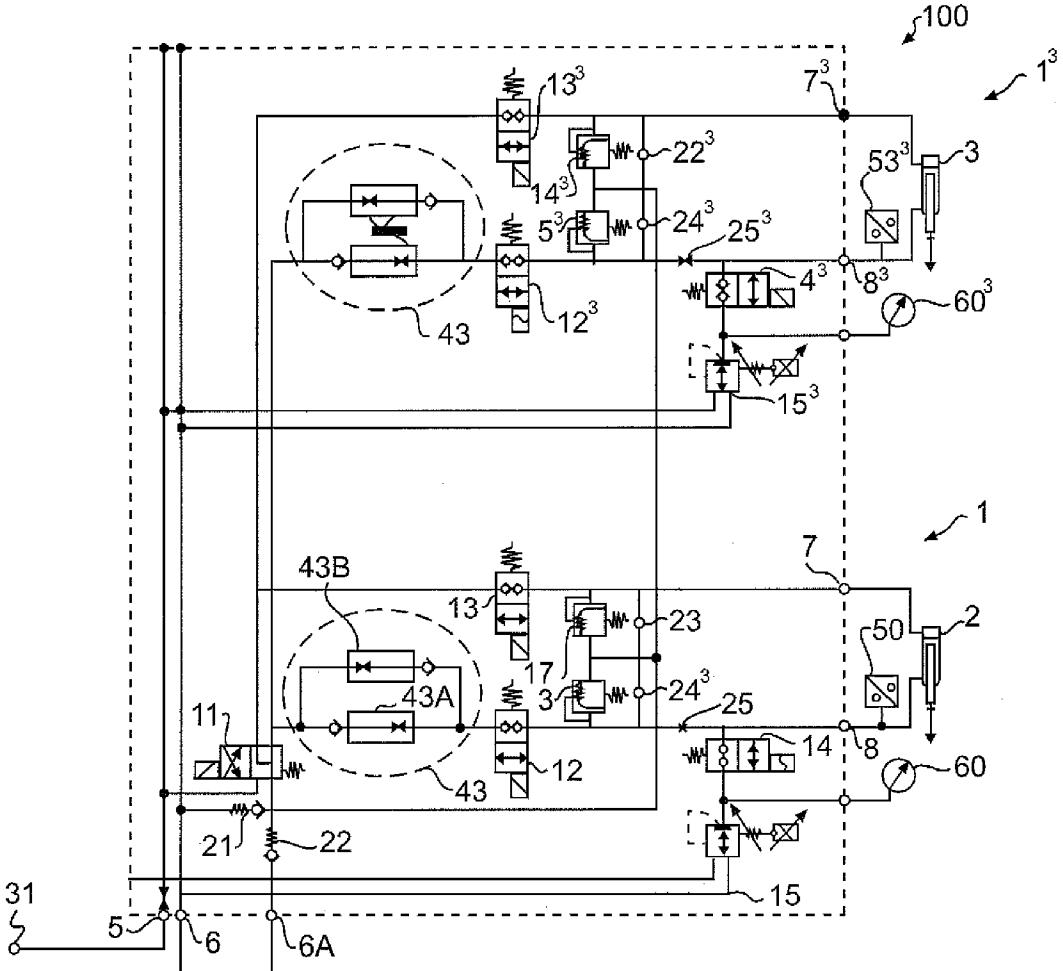
FIG. 11 is a schematic hydraulic diagram of a control system with two hydraulic control arrangements.

FIG. 11 shows a first embodiment of a control system 100 with two control arrangements 1, 1'. They are connected in parallel in such a way as to have as common components merely the directional valve 11, the check valves 21, 22 and also the connections 5, 6 and 6*a*. In all other respects, the second control arrangement 1' is a duplication of the first control arrangement 1 with the same components. The two control arrangements 1, 1' have inter alia pressure control valves 15, 15' which can be actuated separately from one another and also actuating cylinders 2, 3. It is thus possible to set different relief pressures in the cylinders 2, 3. This is for example required if, as a consequence of the asymmetrical widening of the screed 41, the distribution of weight is not symmetrical with respect to the symmetry axis of the main screed 41. The separately controlled pressures are each indicated via the manometers 60, 60'. The pressure sensors 50, 50' detect the respective pressures on the piston side of the hydraulic cylinders 2, 3. These pressures are ideal as parameters for controlling the screed load. Uniform raising and lowering of the screed 41 is possible, owing to the double flow controllers 40, 40' each having two flow controllers 40*a*, 40*b*, even when the screed 41 is extended on one side.

Figure 12:
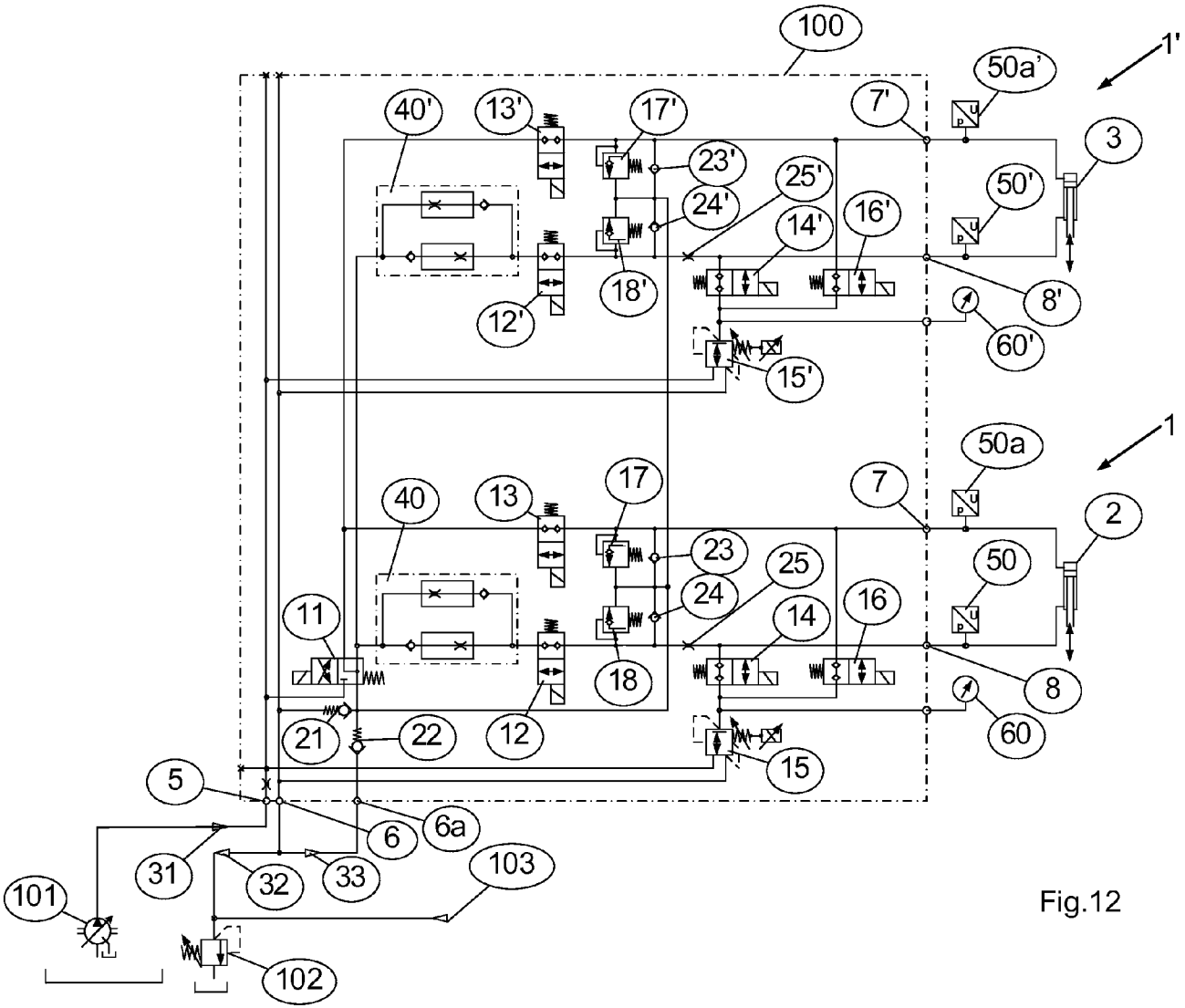
FIG. 12 is a schematic hydraulic diagram of a further control system.

FIG. 12 shows a further exemplary embodiment of the control system 100. Compared to the embodiment shown in FIG. 11, the control system 100 is able to additionally press-on the screed 41 with the aid of additional loading pressures which can be introduced onto the piston sides of the cylinders 2, 3 via the valves 16, 16' (in a manner comparable to FIG. 10). This pressing-on function is not required for most embodiments, provided that the total center of gravity of the screed 41 is located between the articulation points of the two cylinders 2, 3. If, however, the center of gravity should be positioned outside as a result of the design, then a planar and uniform distribution of loads can be ensured via the additional pressing-on. FIG. 12 shows a control pump 101 which delivers a controlled volumetric flow or a controlled pressure. Thus, it enables the supply of controlled volumetric flow or pressure according the requirements. This leads to a low-loss and efficient operation of the hydraulic control arrangement 1 and the control system 100. With the help of the control valve 102 the volumetric flow rate of the hydraulic oil passing the point 103 can be controlled.

The control valve 102 can also be used for pressure control. As shown in FIG. 12, a return line of a further consumer (not shown) can be attached to the point 103.

Figure 13:
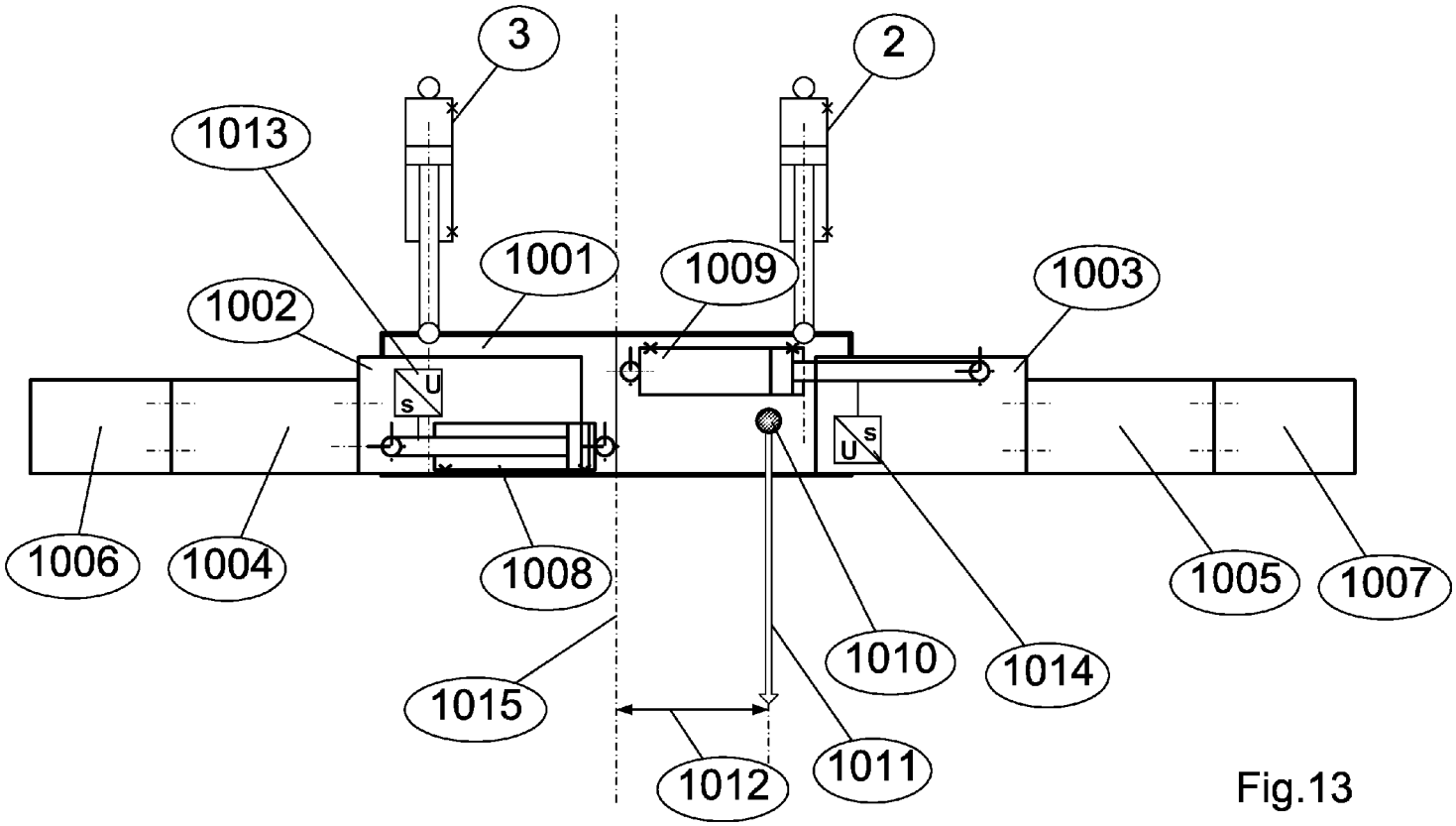
FIG. 13 is a schematic view on the screed 41 having an unbalanced weight distribution.

FIG. 13 schematically shows a view on the screed 41 having an uneven weight distribution. The screed 41 comprises a basic or main screed 1001 and two screed extensions 1002 and 1003 which are hydraulically extendable via extension cylinders 1008 or 1009. The screed extensions 1002, 1003 can be driven out independently from each other. Additionally, further additional screeds 1004 to 1007 can be attached to the screed extensions 1002, 1003 via screws in order to widen the work width of the road finisher if necessary. The actuating cylinders 2 and 3 which are implemented as double-acting hydraulic cylinders are linked to each side of the basic screed 1001 having the same distance from the symmetry axis 1015 of the main screed 1001. In case of a symmetrical widening of the screed 41 the total center of gravity of the screed 41 is located on the symmetry axis 1015. In this case the cylinders 2 and 3 would be preferably supplied with equal loading pressure or relief pressure. There are, however, paving conditions in which an asymmetrical widening of the screed 41 is favorable, as is shown in FIG. 13. In this case the total center of gravity 1010 of the screed 41 shifts to the right about a distance 1012 so that also the line of action of the weight force 1011 of the screed 41 is shifted about a length 1012 from the symmetry axis 1015. In order to counter an uneven installation of asphalt due to an uneven weight distribution, distance measuring devices 1013, 1014 which are arranged at each extension cylinder 1008, 1009 can exactly indicate the movement of the piston-rods of the extension cylinders 1008, 1009. From the measured values the shift 1012 of the center of gravity 1010 can be determined accurately. When the weight distribution is uneven due to an asymmetrical screed widening the actuating cylinders 2, 3 are independently operated so that altogether an equal and even distribution and compression of the material can be reached. For this purpose, for example, the right cylinder 2 could raise the right side of the basic plank 1001 slightly in order to counter an inclination due to the shift 1012 of the center of gravity 1011. It is also conceivable to press the left side of the basic plank 1001 to the material being laid by actuating the left cylinder 3. As a matter of course it is also possible to actuate both cylinders 2, 3 at the same time with independent pressure values.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A road finisher comprising a hydraulic control arrangement for activating a double-acting actuating cylinder which is connected on a piston side to the road finisher and on a piston rod side to a screed of the road finisher, comprising: a supply connection, two tank connections and two consumer connections, a loading pressure or a relief pressure being applied to a piston of the actuating cylinder via the consumer connections, wherein the loading pressure and the relief pressure are controlled as a function of a defined operating state, the hydraulic control arrangement being embodied in such a way that, in a controlling the screed load operating state, the relief pressure supplied to the actuating cylinder on the piston rod side is controlled via a proportional pressure control valve, wherein a control valve is in serial connection with said proportional pressure control valve in a conduit to said piston side consumer connection of said double-acting actuating cylinder and wherein said control valve is implemented to generate in addition to the dead weight of the screed an additional force on said screed, the hydraulic control arrangement further being connected to a control pump via the supply connection, the control pump enabling the supply of controlled volumetric flow or pressure according to actual requirements resulting from a speed of travel of the road finisher so that the volumetric flow of hydraulic oil which is conducted to the hydraulic control arrangement via the supply connection of the supply pressure being present at the supply connection is controllable via the control pump.

2. The road finisher according to claim 1, wherein the loading pressure or relief pressure is controlled as a function of the speed of travel of the road finisher.

3. The road finisher according to claim 1, wherein, in a lowering—the-screed operating state, a hydraulic oil issuing on the piston-rod side and entering the hydraulic control arrangement via a second consumer connection is returned to the piston side of the actuating cylinder via the first consumer connection.

4. The road finisher according to claim 3, wherein, in a lowering-the-screed operating state, the hydraulic oil is supplied from a tank to the piston side of the actuating cylinder via a further external or internal tank connection.

5. The road finisher according to claim 1, wherein the hydraulic control arrangement is a double flow controller, wherein the double flow controller comprises two flow controllers which are connected in parallel and are each provided, on account of check valves, only for one direction of flow.

6. The road finisher according to claim 1, the hydraulic control arrangement comprises a pressure sensor which is embodied to detect a piston-rod side pressure or piston side pressure, the loading pressure or relief pressure being controlled as a function of the detected piston-rod side pressure and/or piston side pressure.

7. A road finisher according to claim 1, further comprising a control system which comprises at least two of the hydraulic control arrangements for activating respective double-acting hydraulic cylinders which, on the piston-rod side, are connected to the screed so as to oppose one another with respect to a symmetry axis of the screed wherein the hydraulic control arrangements are controlled independently.

8. The road finisher according to claim 1, further comprising distance measuring devices with which a widening of the screed is determined quantitatively.

* * * * *